US006941725B2

(12) United States Patent
Gaudenzi

(10) Patent No.: US 6,941,725 B2
(45) Date of Patent: Sep. 13, 2005

(54) METHOD AND DEVICE FOR CLOSING A BOX BY FOLDING A CLOSING LATERAL FLAP

(75) Inventor: Rodolfo Gaudenzi, Bologna (IT)

(73) Assignee: I.M.A. Industria Macchine Automatiche S.p.A., Emilia (IT)

( * ) Notice: Subject to any disclaimer, the term of this patent is extended or adjusted under 35 U.S.C. 154(b) by 0 days.

(21) Appl. No.: 10/468,613

(22) PCT Filed: Feb. 14, 2002

(86) PCT No.: PCT/IB02/00456

§ 371 (c)(1),
(2), (4) Date: Sep. 24, 2003

(87) PCT Pub. No.: WO02/066328

PCT Pub. Date: Aug. 29, 2002

(65) Prior Publication Data

US 2004/0118088 A1 Jun. 24, 2004

(30) Foreign Application Priority Data

Feb. 23, 2001 (IT) ..... BO2001A0098

(51) Int. Cl.[7] ..... B65B 51/10
(52) U.S. Cl. ..... 53/377.5; 53/382.2
(58) Field of Search ..... 53/382.2, 377.5, 53/481, 482, 484, 491

(56) References Cited

U.S. PATENT DOCUMENTS 4,035,989 A * 7/1977 Schuster ..... 53/566
4,196,563 A * 4/1980 Gabrielson et al. ..... 53/456
4,805,375 A * 2/1989 Langen et al. ..... 53/142
5,341,621 A * 8/1994 Martelli ..... 53/377.5
5,729,964 A * 3/1998 Palmer ..... 53/484
5,863,380 A * 1/1999 Gambetti ..... 156/443
6,598,380 B1 * 7/2003 Sgubbi ..... 53/566
6,718,730 B1 * 4/2004 Button et al. ..... 53/248

FOREIGN PATENT DOCUMENTS

| | | |
|---|---|---|
| DE | 554 744 C | 7/1932 |
| DE | 199 35 789 A | 2/2001 |
| EP | 0 978 449 A | 2/2000 |
| JP | 6-99911 | 4/1994 |

* cited by examiner

*Primary Examiner*—Eugene Kim
(74) *Attorney, Agent, or Firm*—William J. Spone; Coleman Sudol Sapone PC

(57) ABSTRACT

A method for closing a box (1) by folding a lateral closing flap (5) extending from an upper edge (6) of a lateral aperture (7) of the box (1) and having at least one foldable edge (8), while the box (1) is being moved along a packaging line (L) in a forward movement direction (W), includes the steps of folding the lateral flap (5) until a connection line (9) of the foldable edge (8) touches stop means (15), then folding the foldable edge (8) on the striking means (15) and toward the lateral aperture (7) of the box (1), so that an outer edge (8*a*) of the foldable edge (8) interacts with contrast means (17), which keep elastically the edge (8) in a position raised with respect to a bottom wall (1*a*) of the box (1), and lastly introducing the edge (8) into the box (1). A device for carrying out the methods has folding means (14) for folding the said lateral flap. Then first pusher means (16) fold the foldable edge (8) toward the box (1) against contrast means (17), while second pusher means (18) are disposed cross-wise and in alignment the said contrast means (17) to strike the lateral flap (5) and insert the lateral flap into the box (1).

12 Claims, 3 Drawing Sheets

METHOD AND DEVICE FOR CLOSING A BOX BY FOLDING A CLOSING LATERAL FLAP

FIELD OF THE INVENTION

The present invention relates to automatic machines for packaging articles into containers.

In particular, the invention relates to a new method for folding lateral flaps of containers, and in particular cases, in a packaging line, where the boxes are filled with articles, and then closed by folding the lateral flaps; the invention relates also to a new device which carries out the above mentioned method.

DESCRIPTION OF THE PRIOR ART

The automatic lines for packaging articles into containers are usually equipped with means for closing the containers, after they have been filled.

If containers are formed by parallelepiped cardboard Bristol-board boxes, they are normally closed by folding, through a 90° angle, flaps situated at the opening edges of the extremities of a pre-glued tubular blank forming the body of the case Each extremity of the tubular blank usually features three lateral flaps, respectively two inner and one outer, which forms the outer face of the case, when it is closed.

The two inner flaps are identical, parallel to each other and are hinged to opposite sides of the blank (usually on the smaller sides thereof).

The inner flaps are folded first, so that they remain inside the case, when it is closed.

According to a very common configuration of the case, the outer flap features two portions, separated by a creasing.

The dimensions of a first portion, extending from the blank edge, are substantially the same as the dimensions of the opening.

After being folded, the first portion covers the whole extension of the opening, so as to form one of the case faces.

A second portion or tucking in end, is folded along the above creasing, toward the case inside, at an approximately right angle with respect to the first portion, and is introduced into the case.

Thus, the second portion cooperates with the two inner lateral flaps, already folded, in maintaining the first portion in the folded position, and consequently in closing the case aperture.

In known devices for automatically closing boxes, the folding of the outer lateral flap includes at least three working steps: a first movement of the flap toward the box by a horizontal pusher; folding of the tucking in end by a vertical pusher, which pushes the tucking in end upwards; a second and final movement of the flap toward the box together with tucking the end in the box.

One of the most common problems of the known devices lies in the fact that operation of the pushers is rather complex, its timing is very complicated, which appears to be particularly critical for the devices operation.

Moreover, known configurations do not allow high production speed in line just due to the complexity.

Another problem results from the fact that the vertical pushers must be measured each time and therefore they must be substituted each time the size of the box and/or of the edge to be folded is changed.

Also in this case the device calibration adjustment is long and difficult.

SUMMARY OF THE INVENTION

An object of the present invention is to propose a method and a device for closing the outer flap of a box, in an automatic packaging line, to obtain a perfect closing of the flap.

Another object of the present invention is to propose a device, which can work with different sizes of the boxes and flaps to be closed, without substitution of the parts.

A further object of the present invention is to propose a device which considerably improves the working speed along the packaging line.

A still further object of the present invention is to obtain the above mentioned closing device by a technical solution which is simple to construct, easy to install, calibrate and maintain, and which has a particularly limited number of parts in movement.

The above mentioned objects are obtained, in accordance with the contents of the claims, by a method for closing a box with open ends, the box by folding a lateral closing flap extending from an upper edge of a lateral aperture of one open end of said box and having a foldable edge joined to said lateral flap by a connection line, said box being moved along a packaging line in a forward movement direction while lying on a bottom wall;

the method being characterized in that it includes the following working steps:

folding said lateral flap until said connection line of said foldable edge goes in abutment against stop means;

folding said foldable edge around said stop means and toward said lateral aperture of said box, so that an outer edge of said foldable edge interacts with contrast means, which keep elastically the edge in a position raised with respect to a bottom wall of said box;

introducing said edge into said box.

A device which carries out he method, includes:

folding means for folding the lateral flap until the connection line of said foldable edge goes in abutment against stop means, said stop means being situated under said folding means;

first pusher means, reciprocating in a direction crosswise with respect to said forward movement direction, between an inoperative position and an operative position in which the first pusher means, together with said stop means, engage with said foldable edge, so as to fold the foldable edge toward the box;

contrast means situated downstream of said striking means and said first pusher means with reference to said forward movement direction, said contrast means being aimed at striking said edge and keep it elastically in a position raised with respect to said bottom wall of said box;

second pusher means, disposed crosswise and in alignment with said contrast means, and reciprocating in a direction transversal to said forward movement direction and in step relation with the first pusher means between an inoperative position and an operative position, in which the second pusher means strike said lateral flap so as to set said lateral flap against the box and introduce said edge into said box.

BRIEF DESCRIPTION OF THE DRAWINGS

The characteristic features of the present invention will be pointed out in the following description of a preferred, but not only embodiment, with reference to the enclosed drawings, in which.

BEST MODES OF CARRYING OUT THE INVENTION

Figure 1:
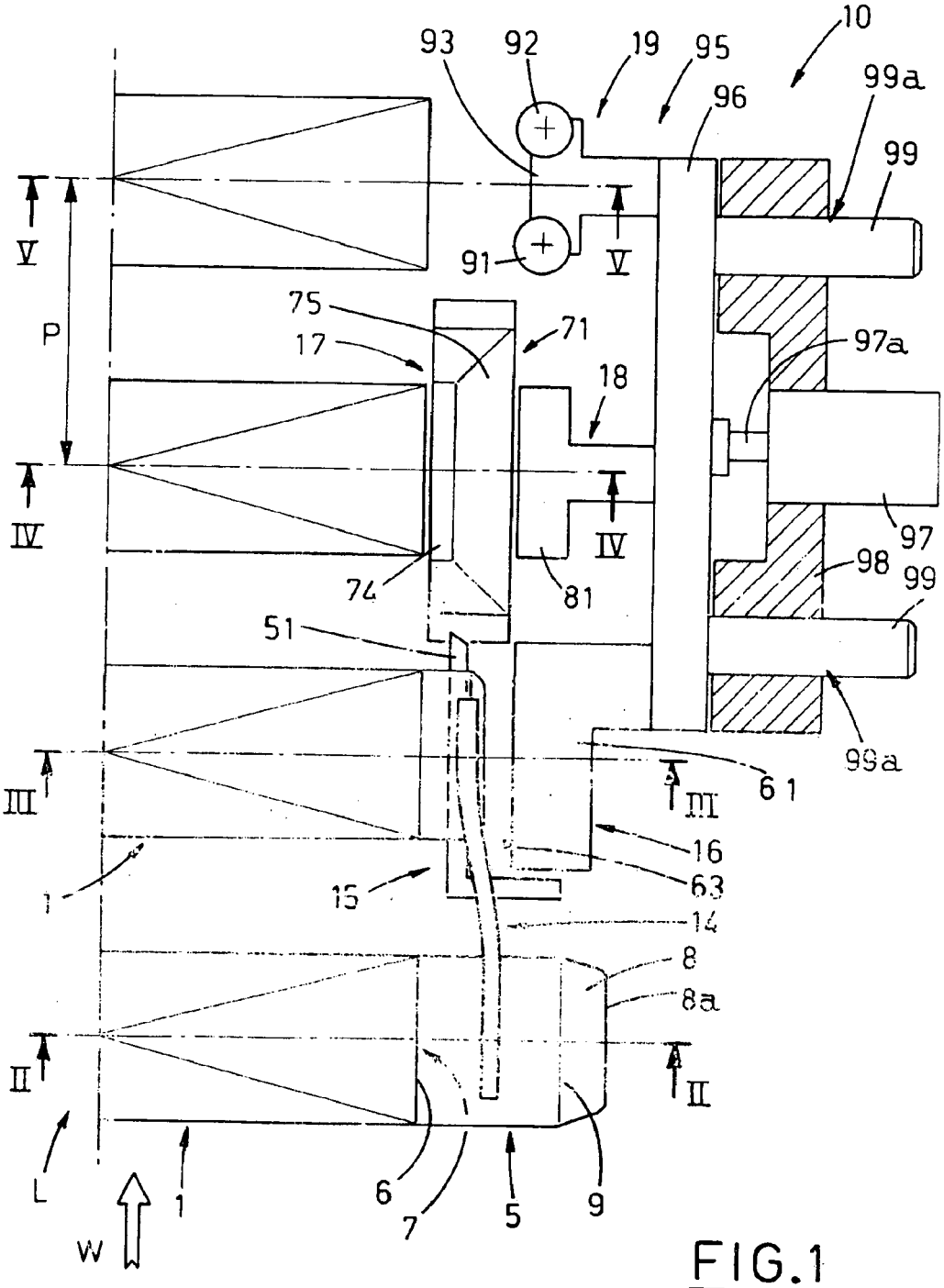
FIG. 1 is a schematic plan view, partially section and with some parts removed for clearness' sake, of a preferred embodiment of the proposed device installed in a box packaging line.

With reference to the FIG. 1, the reference numeral 1 indicates a box of known type, of parallelepiped shape and equipped with a lateral flap 5 to be folded through a 90 degree angle toward the box 1, so as to close it; a plurality of boxes 1 is conveyed stepwise along a conveying line L in a forward movement direction W.

The boxes 1 are situated in known way, spaced apart one from another by a predetermined step P, along the line L, oriented with their longitudinal axes crosswise to the direction W.

For sake of simplicity, FIG. 1 shows only one half of the boxes 1, because the other half is mirror-like made.

Moreover, the structure of the device for conveying the boxes 1 along the line L has been omitted, since known and pertaining to the invention.

A device, indicated with 10, for closing the lateral flap 5 of the box 1 is situated beside the line L.

For sake of simplicity and clarity, in this step, the other inner flaps of the boxes are meant to be already folded by known and not shown devices situated upstream of the closing device 10 with respect to the forward movement direction W.

More precisely, the lateral flap 5 extends from an upper edge 6 of a lateral aperture 7 of the box 1 and has a foldable edge 8.

The foldable edge 8 extends from the side of the flap 5 opposite to the side along which the flap 5 is connected to the upper edge 6, and separated from the flap 5 by a connection line 9 obtained by a weakening or creasing line.

Initially, the foldable edge 8 is aligned with the flap 5.

Figure 2:
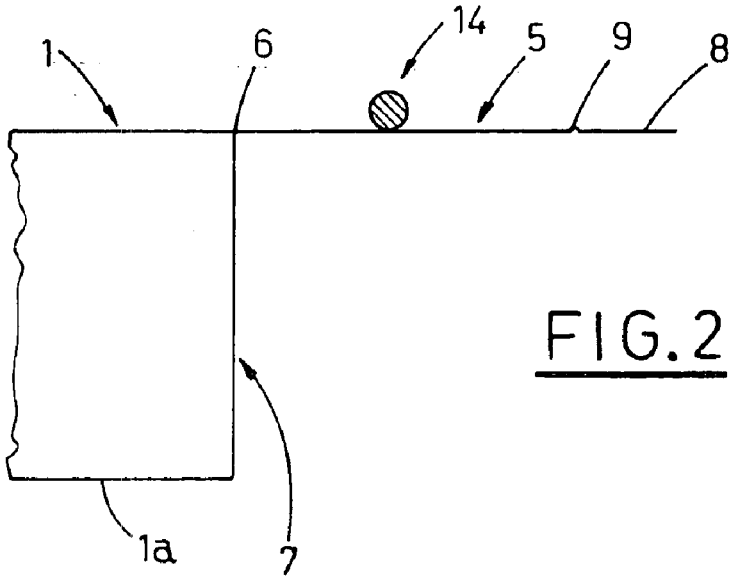
FIG. 2 is a schematic section view taken along II—II of the device of FIG. 1.

The closing device 10 includes folding means 14 (see also FIGS. 2, 3*a* and 3*b*), aimed at making a first partial folding of the flap 5.

The first folding means 14 include a stationary guide 14, of known shape, whose central part is approximately helical and whose extreme parts are approximately straight.

According to what has been shown in FIG. 1, the device 10 includes also striking means 15, situated under a portion of the stationary guide 14, forward with respect to the direction W and at a predetermined distance from the aperture 7.

Figure 3A:
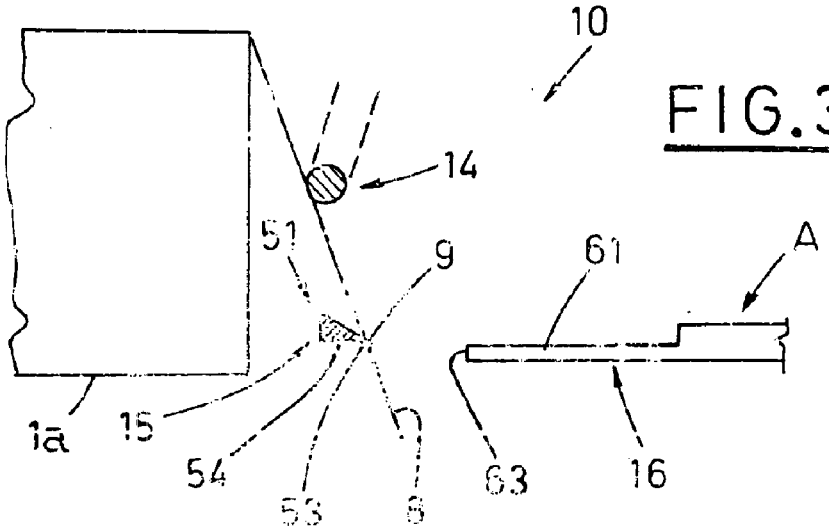
FIGS. 3*a* and 3*b* are schematic section views taken along III—III of the device of FIG. 1, in two different operating steps of the proposed method.
Figure 3B:
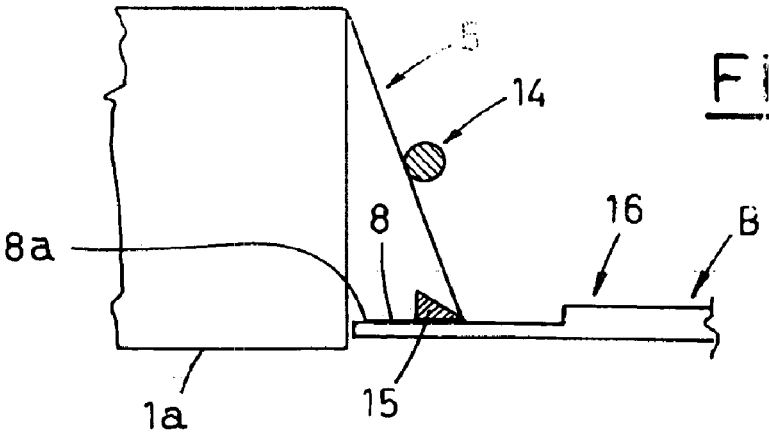

The connection line 9 of the edge 8 of the lateral flap 5 strikes against striking means 15 (FIGS. 3*a*, 3*b*).

The means 15 include a stationary stop 51, whose section is preferably triangular, oriented longitudinally with respect to the forward movement direction W.

The stop 51 includes a cusp 53 in correspondence to the striking line of the above mentioned connection line 9, and a lower surface 54, substantially horizontal and slightly raised with respect to the bottom wall of the box 1.

First pusher means 16 are situated in a position outer with respect to the stop 51. The first pusher means 16 include a first shaped plate 61, which is substantially horizontal and whose front surface 63 is oriented longitudinally with respect to the forward movement direction W.

The front surface 63 extends preferably along the whole width of the flap 5.

The first shaped plate 61 moves alternately, in a substantially horizontal direction, between a backward, inoperative position A (FIG. 3*a*) and a forward, operative position B (FIG. 3*b*), at a height, measured crosswise to the direction W, slightly lower than the height of the stop 51 and in step relation with the forward movement of the box in the direction W.

In particular, as seen in FIG. 3*a*, when the first shaped plate 61 is in the backward position A, it interferes neither with the stop 51 nor with the edge 8.

When, as seen in FIG. 3*b*, the plate 61 is in the forward position B, the front surface 63 of the plate 61 is situated beyond the stop 51 and the edge 8 is folded inward, toward the box 1 between the striking means 15 and the shaped plate 61.

The shaped plate 61 is also fastened to a bearing structure 95 (FIG. 1), which extends parallel to the direction W.

The bearing structure includes a longitudinal bar 96, whose front part carries the aforementioned shaped plate 61, and is fastened to a shaft 97*a* of an actuator 97 mounted on a stationary frame 98.

The rear part of the longitudinal bar 96 carries a pair of stabilizing stems 99, coupled slidingly with corresponding guiding holes 99*a* made in the stationary frame 98.

Figure 4A:
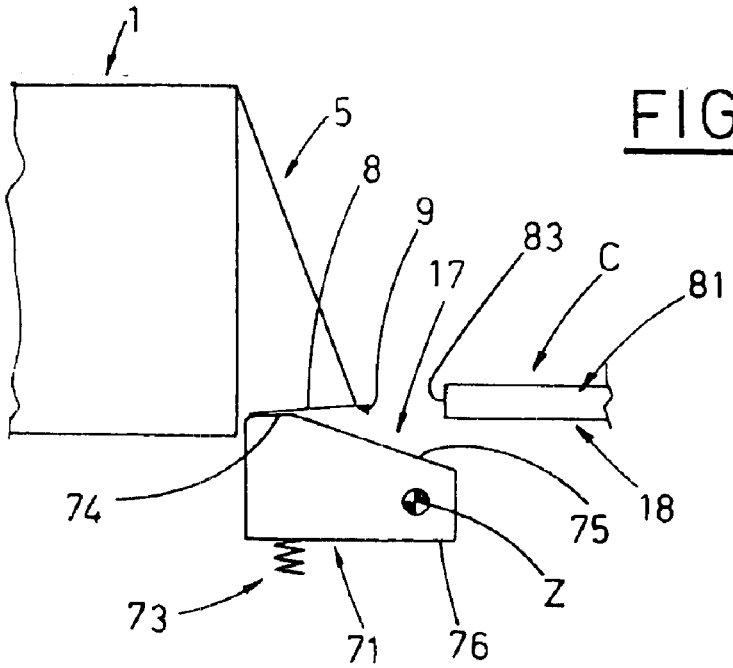
FIGS. 4*a* and 4*b* are schematic section views taken along IV—IV of the device of FIG. 1, in two different operating steps of the proposed method.
Figure 4B:
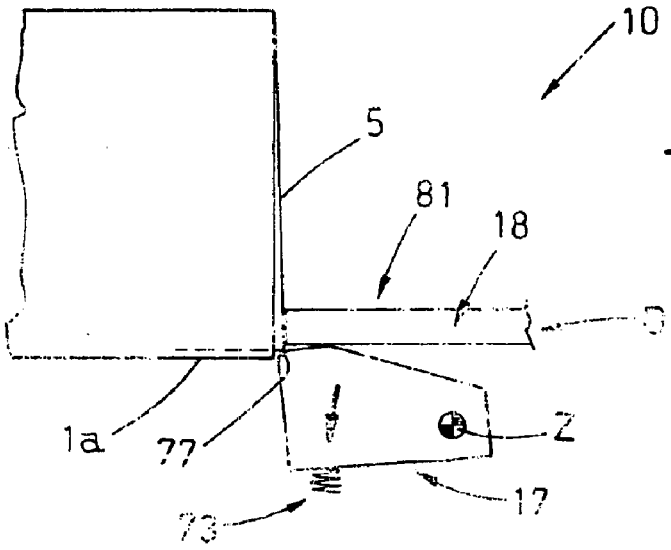

Further contrast means 17 are situated downstream of the stop 51 with respect to the direction W, spaced apart by a step P (see FIGS. 4*a* and 4*b*).

The contrast means 17 intercept the previously folded edge 8 and maintain the outer part 8*a* thereof over the bottom wall 1*a* of the box 1.

The contrast means 17 include a block 71, situated beside and under the box 1, pivoted on a horizontal axis Z near the end of the block 71 which is far from the box 1, and oriented parallel to the forward movement direction W.

The block 71 is free to oscillate on the above mentioned axis A, against the action of a spring 73.

When the block 71 is in a free stable position, the upper surface 74 thereof is situated slightly over the bottom wall 1*a* of the box 1.

The block 71 features also a first sloping surface 75, which extends from the upper surface 74 and slopes gradually upwards.

The block 71 receives the edge 8, lying on the upper surface 74, in order to maintain the outer part thereof 8*a* over the bottom wall 1*a* of the box 1.

The lower end of the spring 73 goes in abutment against a motionless support, not shown, while the upper end thereof acts on the lower surface 76 of the block 71.

According to FIGS. 1, 4*a* and 4*b*, the closing device 10 includes also second pusher means 18, aligned transversely with the block 71 and moving alternatively and in a horizontal direction, in step relation with the first pusher means 16, between a backward, inoperative position C and a forward, operative position D.

The second pusher means 18 include a second shaped plate 81, arranged horizontally, whose front surface 83 is oriented parallel to the forward movement direction W.

The second shaped plate 81 is situated slightly over the bottom wall 1*a* of the box 1, and intercepts the lateral flap 5 near the edge 9 connecting with the edge 8, so as to bring the flap 5 toward a position, in which it wholly leans against the box 1.

Also the second shaped plate 81 is fastened to the bearing structure 95, over the longitudinal bar 96, and consequently, it moves together with the above described first shaped plate 61.

Third pusher means 19 (see FIGS. 1 and 5) are situated downstream of the second pusher means 18, distanced by a further step P.

The third pusher means 19 push the lateral flap 5 further toward the box 1, at an approximately intermediate height, so as to improve the closure of the box 1 with the edge 8 introduced into the box 1.

The third pusher means 19 include a pair of rollers 91, 92, fastened on a support 93 with possibility to rotated freely on axes, which are transversal to the forward movement direction W.

The support 93 moves alternately, in a direction substantially horizontal and perpendicular to the direction W, between a rear, inoperative position E and a fore, operative position F (FIG. 5), in which the support 93 engages with the lateral flap 5.

The rollers 91, 92 are aimed at preventing the rubbing contacts with the flap 5, which could damage the latter.

The support 93 is fastened motionless on the longitudinal bar 96, and consequently, its movements are synchronous with the movements of the first pusher means 16 and of the second pusher means 18.

The method for closing the lateral flap 5 of the box 1, according to the present invention and by the device 10, will be described in the following beginning from a situation, in which the box 1, whose lateral flap 5 is wholly spread in raised position, is moved forward by a step P along the packaging line L, after the other two lateral inner flaps have been folded.

The box 1 is first brought to the upstream part of the stationary guide 14, which is situated at a higher level than the flap 5.

During the subsequent movement by a step P, the helical part of the stationary guide 14 intercepts the flap 5, thus folding it partially and bringing the connection line 9 of the edge 8 to abut against the cusp 53 of the stop 51, when the box 1 stops again.

At this point, the actuator 97 is operated to move the first shaped plate 61 from the backward position A to the forward position B (FIGS. 3*a*, 3*b*).

During the above movement, the first shaped plate 61 intercepts the edge 8, immediately below the stop 51, and folds it, bringing the outer part 8*a* thereof to the level slightly higher than the level of the bottom wall 1*a* of the box 1.

The first shaped plate 61 remains in the forward position A also during the first part of the next forward movement of the box 1, by a further step P, until the folded edge 8 is received again by a second surface 77 of the contrast block 71.

Then, the first shaped plate 61 is brought back to the backward position B.

When the box 1 is stopped again, the actuator 97 is operated again to move the second shaped plate 81 from the backward position C to the forward position D.

During this movement, (FIGS. 4*a*, 4*b*), the second shaped plate 81 strikes first the flap 5, near the connection line 9, pushing it toward the box 1.

Then, the second shaped plate 81 strikes the block 71 in the region of the first sloping surface thereof, and drives it to oscillate downwards, against the action of the spring 73.

The positioning of the second shaped plate 81 and of the block 71 is such that the edge 8 is perfectly introduced into the lateral aperture 7, directly over the bottom wall 1*a* of the box 1.

At this point, the box 1 is moved forward by another step, while the second plate 81 is brought back to the backward position C.

Figure 5:
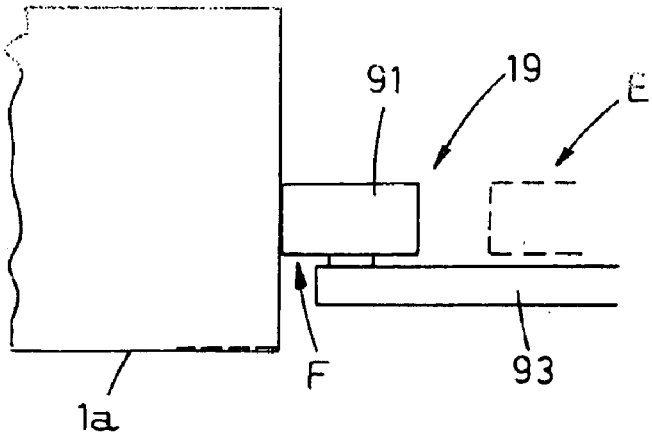
FIG. 5 is a schematic section view taken along V—V of the device of FIG. 1.

At the subsequent stop of the box 1, the actuator 97 is operated again and the third pusher means 19 move from the backward position E to the forward position F (FIG. 5).

In the latter position, the rollers 91 and 92 intercept the flap 5 to put it against the whole lateral aperture 7, thus closing the box 1 by introducing the edge 8 into the box 1.

It is understood that for the purposes of the present invention, the first pusher means 16, second pusher means 18 and third pusher means 19 could be operated independently and in different steps, anyway correlated.

The third pusher means 19 could be also fixed. In this case, the rollers 91, 92 would intercept the lateral flap 5 for a longer time.

The advantages obtained by the present invention lie above all in the adaptability of the above described closing device 10 to different sizes of the box 1.

Actually, the device 10 does not include parts for a precise size, therefore it can be used for closing a vast variety of box sizes of different dimensions of the lateral flap.

Another advantage lies in fact that the moving means of the device 10 perform the basic movements and all of them in the same direction, crosswise to the boxes forward movement.

This allows to considerably increase the operation speed of the packaging line, thus overwhelming the disadvantages of known devices.

A further advantage results from the extreme simplicity and reliability of the closing device, which requires few and simple calibration and maintenance operations.

What is claimed is:

1. A device for closing a box (1) with open ends, the box closed by folding a lateral closing flap (5) extending from an upper edge (6) oh lateral aperture (7) of one open end of said box (1) and having a foldable edge (8) joined to said lateral flap (5) by a connection line (9), said box (1) being moved along a packaging line (L) in a forward movement direction (W) while lying on a bottom wall (1*a*); the device comprising:

folding means (14) rot folding said lateral flap (5) until the connection line (9) of said foldable edge (8) is in abutment against stop means (15), said stop means (15) being situated under said folding means (14);

first pusher means (16), reciprocating in a direction crosswise with respect to said forward movement direction (W), between an inoperative position (A) and an operative position (B) in which the first pusher moans (16) and said stop means (15), engage with said foldable edge (8) to fold the foldable edge (8) toward the box (1);

contrast means (17) located downstream of said stop means (15) and said first pusher means (16) with reference to said forward movement direction (W), said contrast means striking said edge (8) and keeping the edge elastically in a position raised with respect said bottom wall (1*a*) of said box (1);

second pusher means (18), disposed crosswise and in alignment with said contrast means (17), and reciprocating in a direction transversal to said forward movement direction (W), said second pusher means moved synchronously with the first pusher means (16) between an inoperative position (C) and an operative position (D), in which the second pusher means (18) strike said lateral flap (5) to set said lateral flap against the box (1) and introduce said edge into said box (1);

said contrast means (17) including a block (71), located beside and under said box (1) and pivoting on an axis (Z), which is substantially parallel to said forward movement direction (W), said block (71) oscillating on said axis (Z) against the elastic reaction means (73), so that the upper surface (74) of said block (71) receives said edge (8).

2. The device according to claim 1, wherein said stop moans (15) include a stop member (51) with a triangular section, oriented longitudinally with respect to said forward movement direction (W), said stop member (51) having a cusp (53) in correspondence with the striking line of said connection line (9) of said edge (8), and a lower surface (54), substantially horizontal arid raised with respect to the bottom wall (1*a*) of the box (1).

3. The device according to claim 1, wherein said first pusher means (16) include a first substantially horizontal shaped plate (61) with a front surface (63) oriented parallel to said forward movement direction (W).

4. The device according to claim 1, wherein said block (71) has a first sloping surface (75), which inclines gradually outwardly away from the upper surface (74), and a second sloping surface (77), which inclines gradually upwardly away from the upper surface (74), with respect to said forward movement direction (W).

5. The device according to claim 1, wherein said elastic reaction means (73) include a spring, acting on a lower surface (76) of said block (71) to keep said upper surface (74) of said block (71) in a position raised with respect to the bottom wall (1*a*) of said box (1).

6. The device according to claim 1, wherein said second pusher means (18) include a second substantially horizontal shaped plate (81) having a front surface (83) which is parallel to said forward movement direction (W).

7. The device according to claim from 1, wherein said first pusher means (16) and said second pusher means (18) are integral with each other and are fastened to one bearing structure (95).

8. The device according to claim 7 herein said bearing structure (95) includes a longitudinal bar (96), having a front part which carries said first pusher means (16) and said second pusher means (18), and having a rear part which carries a pair of stabilizing stems (99), slidingly received within corresponding guiding holes (99*a*) in said stationary frame (98).

9. The device according claim 1, further including third pusher means (19), situated downstream of said second pusher means (18), for pushing said lateral flap (5) further toward said box (1), to complete the box (1) closing.

10. The device according to claim 9, wherein said third pusher means (19) have a pair of rollers (91,92), mounted on a support (93) and being rotatably mounted on respective axes, crosswise to said forward movement direction (W), said support (93) moving alternately, in a direction substantially horizontal and perpendicular to the forward movement direction (W), between a rear, inoperative position (E) and a forward, operative position (F), in which said rollers (91,92) engage with the lateral flap (5).

11. The device according to claim 9, wherein said first pusher means (16), second pusher means (18) and third pusher means (19) are integral with each other and are fastened to one bearing structure (95).

12. The device according to claim 11, wherein said bearing structure (95) includes a longitudinal bar (96) having a front part which carries said first pusher means (16), said second pusher means (18), and said third pusher means (19), and having a rear part which carries a pair of stabilizing stems (99), slidingly received within corresponding guiding holes (99*a*) in said stationary frame (98), said longitudinal bar (96) being fastened to a shaft (97*a*) of an actuator (97) mounted on a stationary frame (98).

* * * * *